US007770816B2

(12) United States Patent
Rieder

(10) Patent No.: US 7,770,816 B2
(45) Date of Patent: Aug. 10, 2010

(54) LANCE HEAD FOR A SNOW LANCE AND NOZZLE ARRANGEMENT

(75) Inventor: Walter Rieder, Eggen (IT)

(73) Assignee: Technoalpin GmbH, Bozen (IT)

( * ) Notice: Subject to any disclaimer, the term of this patent is extended or adjusted under 35 U.S.C. 154(b) by 0 days.

(21) Appl. No.: 11/212,641

(22) Filed: Aug. 29, 2005

(65) Prior Publication Data

US 2006/0079137 A1 Apr. 13, 2006

(30) Foreign Application Priority Data

Oct. 8, 2004 (DE) ..... 10 2004 049 430
Nov. 9, 2004 (DE) ..... 10 2004 053 984

(51) Int. Cl.
*F25C 3/04* (2006.01)

(52) U.S. Cl. ..... 239/14.2; 239/128; 239/132.1; 239/139; 239/132; 222/146.2; 165/182

(58) Field of Classification Search ..... 239/14.2, 239/14.1, 2.2, 139
See application file for complete search history.

(56) References Cited

U.S. PATENT DOCUMENTS 3,302,833 A * 2/1967 Leika ..... 222/146.1
4,749,127 A * 6/1988 Ash ..... 239/14.2
5,544,701 A * 8/1996 Elder ..... 165/80.5
6,056,205 A * 5/2000 Dupre ..... 239/14.2
6,129,290 A * 10/2000 Nikkanen ..... 239/2.2
6,508,412 B1 * 1/2003 Pergay et al. ..... 239/14.2
6,543,699 B1 * 4/2003 Dupre ..... 239/14.2
6,719,209 B1 * 4/2004 Pergay et al. ..... 239/14.2
2004/0035947 A1 * 2/2004 Ratnik ..... 239/2.2

FOREIGN PATENT DOCUMENTS

DE 699 02 400 4/2003
EP 1 296 105 9/2002

* cited by examiner

*Primary Examiner*—Dinh Q Nguyen
(74) *Attorney, Agent, or Firm*—Hoffman Wasson & Gitler

(57) ABSTRACT

In a snow lance head for use with a snow lance with a housing having nozzles for the outlet of water and/or air and with at least one first chamber formed in the interior of the housing, through which water emerging from at least some of the nozzles flows, the surface area of the inner surface of the chamber is at least equal to, but preferably greater than the outer surface of the housing.

10 Claims, 4 Drawing Sheets

LANCE HEAD FOR A SNOW LANCE AND NOZZLE ARRANGEMENT

BACKGROUND OF THE INVENTION

The invention relates to a snow lance head for use in a snow lance with a housing having nozzles for the outlet of water and/or air and with at least one first chamber formed in the interior of the housing through which water emerging from at least some of the nozzles flows.

The invention also relates to a nozzle arrangement with at least one nucleator and at least one water nozzle.

So-called "snow lances" used to produce artificial snow are known in the art and consist essentially of a snow lance body and of at least one snow lance head provided on the snow lance body, the head has one or more nozzles (12, 15, 18) for compressed air and water under pressure, wherein at least one nozzle is designed as a so called "nucleator", which is fed with water and air and which is used to produce nuclei, i.e. to produce small kernels or very small frozen particles, which initiate the formation of snow from the water sprayed from the snow lance head into the air current.

It is an object of the invention is to provide for a snow lance head that effectively prevents the formation of ice on the lance head, in particular preventing the housing of the head from icing up, under unfavorable weather conditions, especially during low temperatures and a strong headwind, which causes considerable accumulation of moisture on the outer surface of the snow lance head due to water from the nozzles.

SUMMARY OF THE INVENTION

An objective is achieved by a snow lance head for use in a snow lance with a housing having nozzles for the outlet of water and/or air and with at least one first chamber formed in the interior of the housing through which water emerging from at least some of the nozzles flows, with the inner surface of the chamber being at least equal to the outer surface of the housing, preferably greater than outer surface of the housing.

Furthermore this objective is achieved by nozzle arrangement with at least one nucleator and with at least one water nozzle with the nucleator and the at least one water nozzle being provided on a common support.

A special feature of the snow lance head according to the invention is the fact that limiting surface of the chamber which chamber is formed in the interior of the housing and through which chamber water flows during normal operation of the snow lance head and of the snow lance is equal to, or preferably greater than the outer surface of the housing, so that even under unfavorable weather conditions, i.e. at very low temperatures, the outer surface of the housing is kept at a temperature above the freezing point by the water flowing through the first chamber and the snow lance head is prevented from icing up already by these means.

In a preferred embodiment, the housing is convexly rounded on its outside at least in the area where the nozzles are located, preferably three-dimensionally, i.e. with or around at least two spatial axes extending perpendicular to each other, which results in faster and more effective dripping of water on the outer surface of the housing, for example after it has emerged from the nozzles. This special housing form also helps to prevent the formation of ice, in particular also the accumulation of ice on the outside of the housing.

The nozzle arrangement according to the invention, and can be used, for example, for a snow lance head, and can also be used with other snow lance heads or snow generators and which combines at least one nucleator and one further water nozzle on a common support, features a compact design, space-saving and simplified installation and a high degree of service friendliness.

BRIEF DESCRIPTION OF THE DRAWINGS

The invention is described below based on an exemplary embodiment with reference to the drawings, wherein:

FIG. 6*a* shows a frontal view of the side of the snow lance head housing comprising the nozzle arrangement;

FIG. 6*b* shows a cross section corresponding to line B-B of the snow lance head housing of FIG. 6*a;* and FIG. 6*c* shows a cross section corresponding to line B-B of the snow lance head housing of FIG. 6*a*.

DETAILED DESCRIPTION OF THE INVENTION

Figure 1:
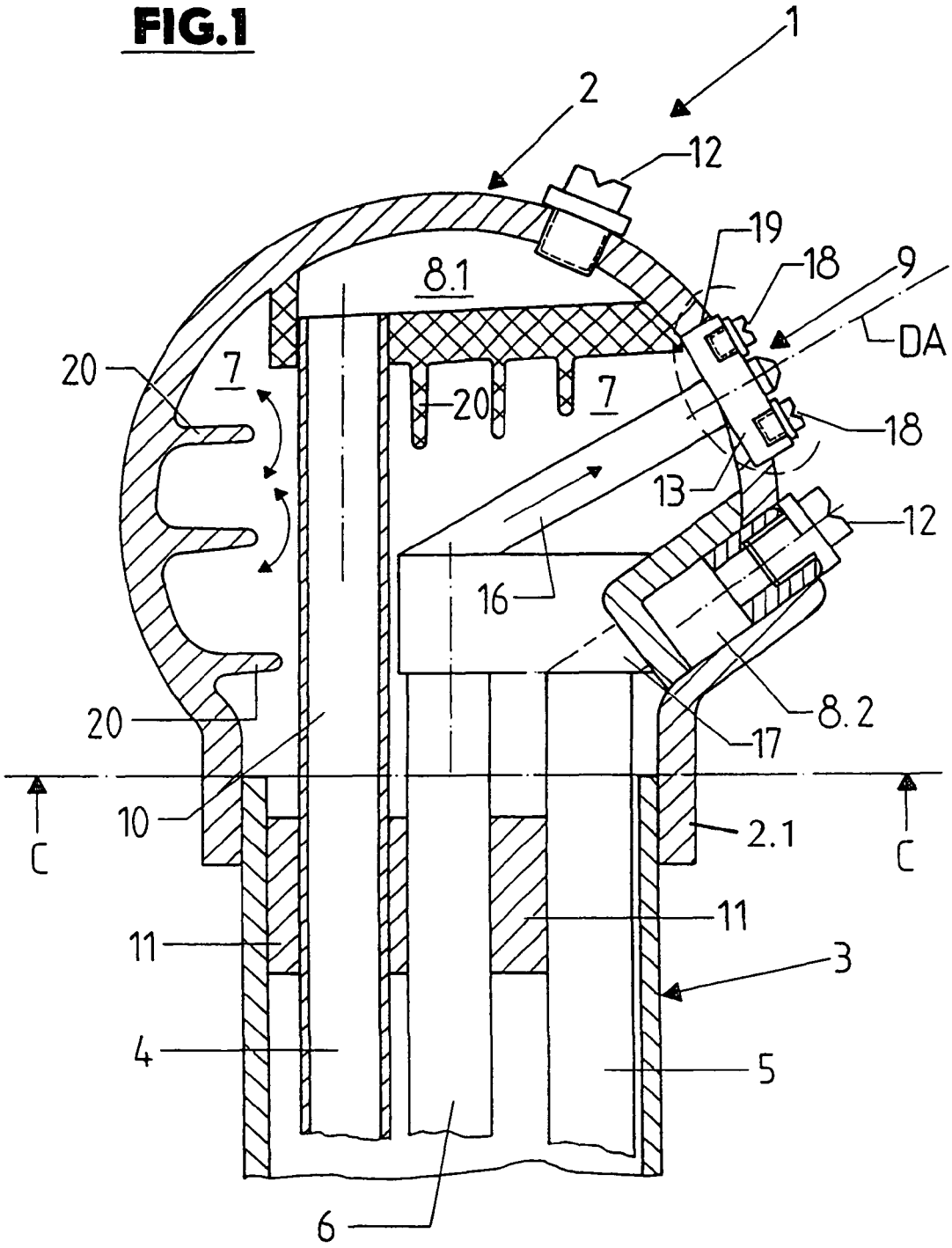
FIG. 1 shows a simplified cross section of a head of a snow lance.

The snow lance head generally designated 1 in the drawings is part of a snow lance for generating snow from water and air and is mounted, for example, on the top of snow lance body or member 3.

The snow lance head 1 is made up of a spherical housing 2, which in the depicted embodiment is made of aluminum or an aluminum alloy and which on the end of a schematically depicted snow lance body 3 is fastened with a housing section 2.1 to the latter tightly overlapping and features a nozzle arrangement 9.

Four separated channels 4, 5, 6, 21 are provided in the snow lance body 3, namely a first and second channel 4 and 5 for feeding water and a third channel 6 for feeding compressed air, preferably cooled compressed air, to the snow lance head 1 and a fourth channel 21 (not depicted in FIG. 1) for feeding water at a fixed rate that means water the amount of which is not controlled depending on the weather conditions.

The interior of the housing 1 in the depicted embodiment is sub-divided essentially into three separate chambers, namely the larger chamber 7 and a first and second smaller chamber 8.1, 8.2, which in the depicted embodiment concentrically enclose a nozzle arrangement 9, provided on the side of the snow lance head 1, and the middle axis DA of the nozzle arrangement, and which are formed within the spherical outer wall of the housing 2. The first smaller chamber 8.1 is connected to the first channel 4 by means of a connecting channel 10 formed in the housing 2 or by a connecting line, which in the depiction in FIG. 1 is connected at its lower end with the first channel 4 and leads into the upper section of the first smaller chamber 8.1. The second channel 5 leads into the larger chamber 7, which is closed in a suitable manner at the junction to the snow lance 3, for example by an end piece 11 that closes the snow lance body 3 at its upper end outside of the first through third channels 4-6.

Distributed around the nozzle arrangement 9 or its axis DA several nozzles 12 are provided, which are connected with the first and second smaller chamber 8.1, 8.2 and which are used to discharge water in finely distributed form.

The nozzle arrangement 9 in the depicted embodiment consists of a disk-shaped support 13, the middle axis of which is the nozzle axis DA. In the middle, the support 13 has an opening 14 with inner threads in which a nucleator 15 is provided, i.e. a nozzle that can be pressurized with an air-water mixture for creating nuclei, i.e. miniature or micro snow or ice particles initiating the generation of snow in the air current emerging from the nucleator 15. By means of an internal connection 16 in the housing, the nucleator 15 is connected with the third channel 6 for feeding air and the second smaller chamber 8.2 is connected via a second internal connection 17 in the housing with the second channel 5 for feeding water. The air fed via the third channel 6 is mixed with the fixed water to from an air-water mixture before emerging from the nucleator 15.

On the support 13, distributed around the nucleator 15, a plurality of water nozzles 18 is provided, by means of which the water or fixed water emerges from the larger chamber 7 in the form of fine spray into the air current of the nucleator 15.

While the nucleator 15 has one or more nozzle openings, of which the axis of the nozzle opening 15.1 is coincident with the axis DA, and the axes of the nozzle openings 15.2 form an angle smaller than 90° with the nozzle axis DA, which (angle) opens toward the side facing away from the housing interior, the nozzles 18 are oriented with their axes parallel to the nozzle axis DA.

The nozzles 18 are fastened to the support 13 by screwing. The support 13 is fastened in an opening 19 of the housing 2 by suitable means, e.g. by screwing, so that the inner side of the support 13 is part of the inner surface of the chamber 7.

Figure 4:
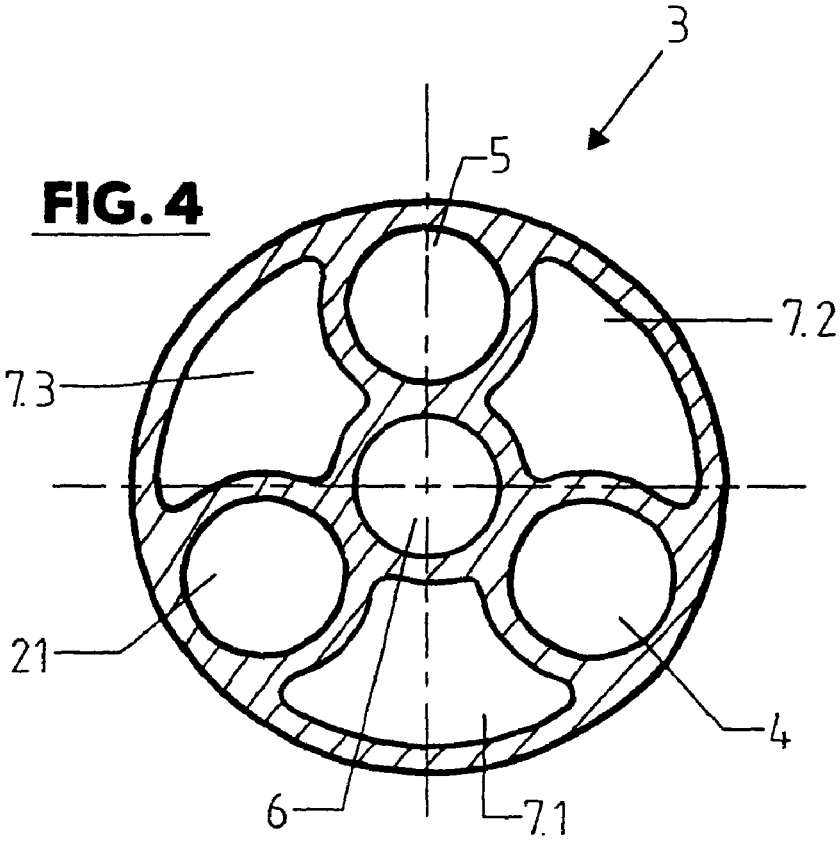
FIG. 4 shows a cross section corresponding to line C-C of FIG. 1.

FIG. 4 shows a cross section along the line C-C indicated in FIG. 1 of the snow lance 3, which has four separated channels 4, 5, 6, 21. The first and second channels 4, 5 are provided for feeding water into the first and second chambers 8.1, 8.2 of the housing 2 and the third channel 6 is provided for feeding air to the nucleator 15. By means of the fourth channel 21 of the snow lance 3, fixed water is fed to the larger chamber 7, flowing through the hollow spaces, for example the hollow chambers 7.1, 7.2, 7.3 of the larger chamber 7 depicted in FIG. 4 and energy is transmitted to the spherical housing 2.

Figure 3:
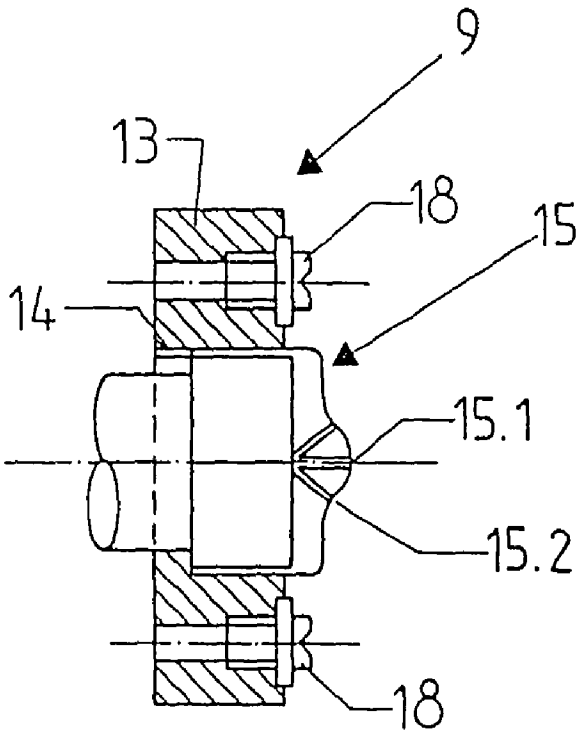
FIG. 3 shows a cross section corresponding to line A-A of FIG. 2.
Figure 2:
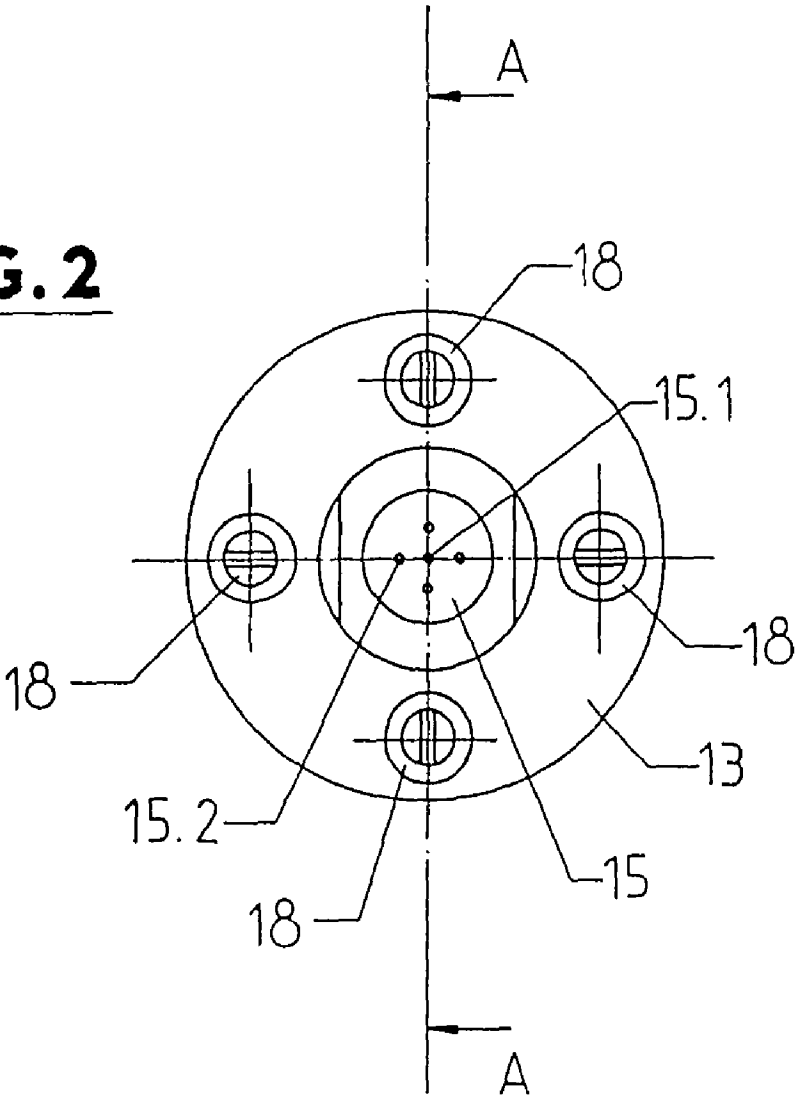
FIG. 2 shows a component representation in top view of a multi-purpose nozzle for use in a snow lance, for example in the snow lance of FIG. 1.
Figure 5:
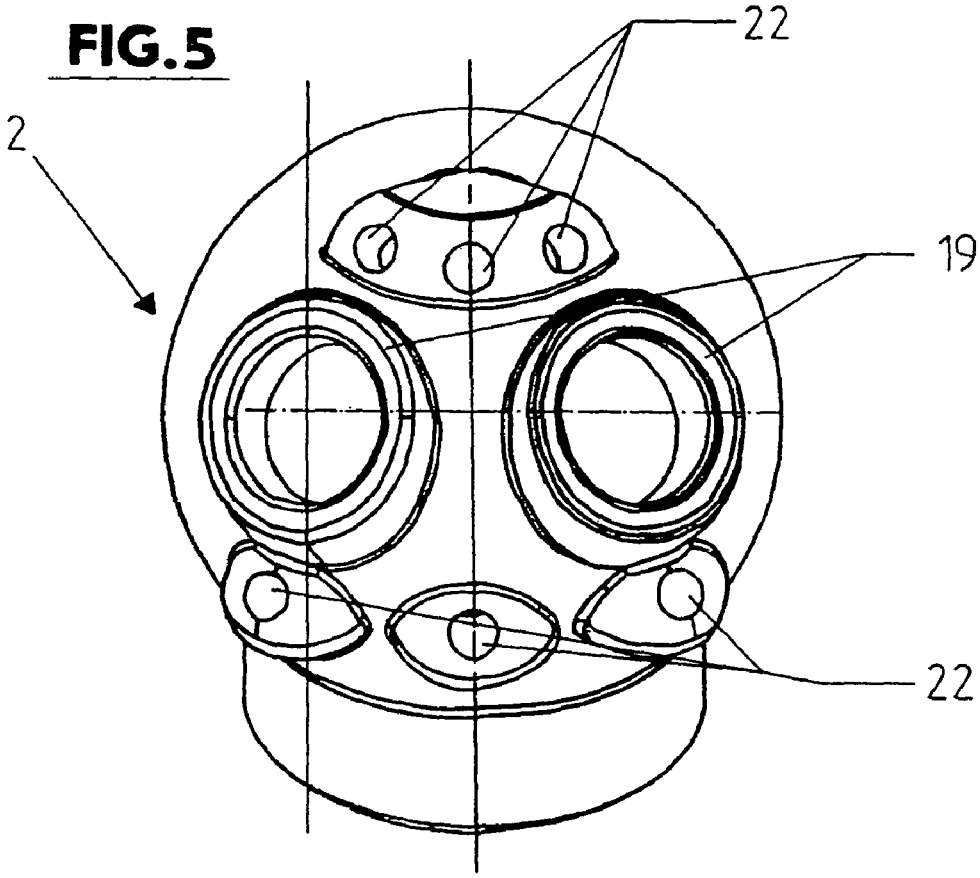
FIG. 5 shows a frontal view of a snow lance head housing for use in a snow lance, for example in the snow lance according to FIG. 1.

FIG. 5 shows in an alternative embodiment, by way of example, the frontal view of a snow lance head housing 2 without nozzles 12 or a nozzle arrangement 9. The depicted snow lance head housing 2 has a first and a second opening 19, each of which holds a nozzle arrangement 9 according to FIGS. 2 and 3. Furthermore, additional openings 22 are provided in the snow lance head housing 2 above and below the openings 19 for holding additional nozzles 12, whereby in the depicted embodiment three openings 22 are located above and below the openings 19 in the snow lance head housing 2 along a circular disk-shaped line on the housing surface. In a preferred embodiment, the openings 19 and 22 each have inner threads for screwing in of the circular disk-shaped support 13 of the nozzle arrangement 9 or of the nozzles 12.

Figure 6:
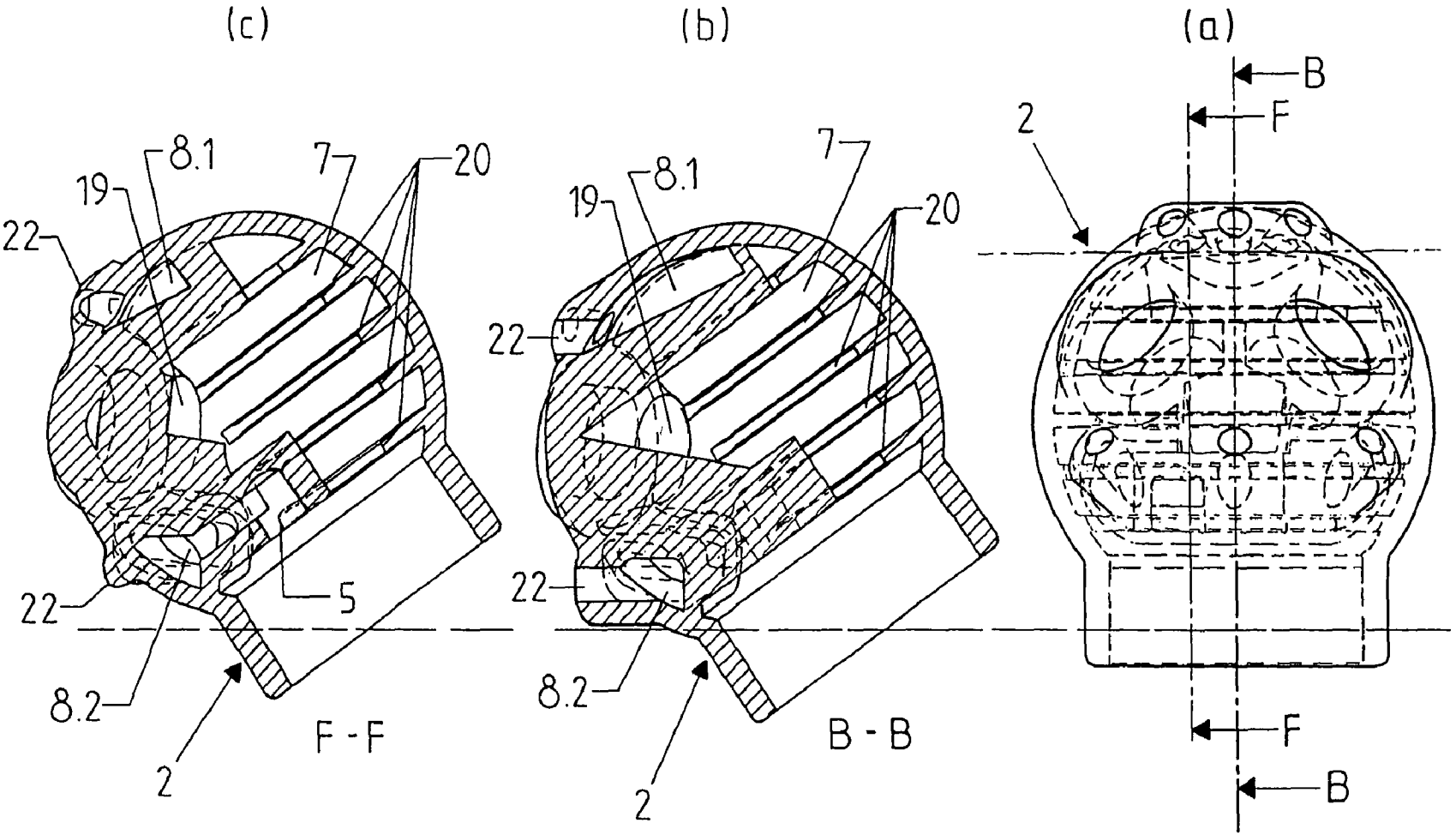

FIG. 6*a* shows, by way of example, a depiction of the schematic representation of the snow lance head housing 2 according to FIG. 5 from a slightly different angle of view. FIGS. 6*b* and 6*c* each show a cross section along the axes B-B and F-F of the snow lance head housing 2 depicted in FIG. 6*a*. FIG. 6*b* shows, by way of example, one of the openings 22 for holding the nozzles 12, which are fed with water by means of the first and second smaller chamber 8.1, 8.2. Furthermore, the larger chamber 7 is depicted, which has several ribs 20 for increasing the inner surface of the chamber 7.

FIG. 6*c* shows a further cross section along the axis F-F of the housing 2 according to FIG. 6*a*, from which the feeding of water via the second channel 5 to the second smaller chamber 8.2 is clearly depicted.

The fixed water fed via the fourth channel 21 to the larger chamber 7 emerges partially at the nucleator 15 and partially at the nozzles 18. Water is additionally fed via the first and second channel 4, 5 to the first and second smaller chambers 8.1, 8.2 and to the nozzles 12 connected to these chambers, in particular when the weather conditions allow additional generation of snow with the water emerging from the nozzles 12.

A special feature of the snow lance head 1 is the fact that the inner surface limiting the chamber 7 is provided at least partially with ribs 20 protruding from the respective inner surface, so that the inner surface of the housing 2 through which the water flows in the chamber 7 is significantly larger than the outer surface of the housing and therefore taking into consideration in particular also the highly heat-conductive material used for the housing 2, it is assured that the outer surface of the housing 2 is maintained within a temperature range above the freezing point even when it is extremely cold.

Furthermore, the compact design and spherical shape of the housing 2 results in fast dripping of water spray from the nozzles 12 and 18 accumulating on the outside surface of the housing, thus effectively preventing the formation of ice on the snow lance head 1.

The nozzle arrangement 9 features the use of standardized components to the greatest possible extent, a compact design, simplified mounting and a high degree of service friendliness, for example by the fact that all components of said nozzle arrangement 9 are located on a common support 13 in a very compact manner.

Furthermore, the nozzle arrangement 9 provides additional protection against the formation of ice, due to the warmer air of the nucleator 15.

In a preferred embodiment of the snow lance head 1, the latter comprises at least two nozzle arrangements 9, whereby the nozzle axes DA of the at least two nozzle arrangements 9 form an angle between 30° and 50°, in particular 40°.

The invention was described above based on an exemplary embodiment. It goes without saying that numerous modifications and variations are possible without abandoning the underlying inventive idea upon which the invention is based.

REFERENCE NUMBERS

1 snow lance head
2 snow lance head housing
3 snow lance
4 first channel in snow lance 3
5 second channel in snow lance 3
6 third channel in snow lance 3
7 larger chamber in housing 2
7.1, 7.2, 7.3 hollow chamber sections of larger chamber 7
8.1, 8.2 first and second smaller chambers in housing 2
9 nozzle arrangement
10 connecting channel
11 end piece
12 nozzle
13 disk-shaped support
14 opening
15 nucleator
15.1, 15.2 nozzle opening of nucleator
16 connection
17 opening
18 nozzle
19 opening

20 rib
21 fourth channel in snow lance 3
22 opening
DA nozzle axis of nozzle arrangement 9 and of nucleator 15

What is claimed is:

1. A snow lance head comprising a housing comprising nozzles for the outlet of water or air, the housing having an interior surface and an exterior surface;

at least one chamber formed in the interior of the housing through which water emerges from the nozzles, and having an interior surface formed in the housing; and wherein the interior surface of the chamber has ribs extending from the interior surface of the chamber to increase the surface area in contact with the water such that the interior surface of the chamber has a surface area greater than a surface area of the outer surface of the housing; and wherein the housing is spherical on the exterior surface and the nozzles are located on a spherical exterior surface of the housing.

2. The snow lance head according to claim 1, wherein the housing is made of a metal that conducts heat selected from aluminum or an aluminum alloy.

3. The snow lance head according to claim 1, wherein the housing has a round shape on the greater part of its outer surface.

4. The snow lance head according to claim 1, wherein the housing is spherical.

5. The snow lance head according to claim 1, wherein at least one further chamber is provided in the housing and is connected with nozzles on the outside of the housing.

6. The snow lance head according to claim 5, wherein the first chamber can be pressurized with fixed water for operation of the snow lance head and the at least one further chamber can be pressurized with water in a controlled manner.

7. The snow lance head according to claim 1, wherein a nozzle arrangement comprising at least one nucleator, the at least one nucleator and at least one water nozzle are provided on a common support.

8. The snow lance head according to claim 7, wherein the support is disk-shaped.

9. The snow lance head according to claim 8, wherein at least two further nozzles are provided on the support radially offset from one nozzle axis (DA) of the nucleator.

10. The snow lance head according to claim 1, wherein a support is inserted in a recess in a part of the housing wall limiting the first chamber.

* * * * *